US006099188A

United States Patent [19]

Ovitt et al.

[11] Patent Number: 6,099,188

[45] Date of Patent: Aug. 8, 2000

[54] ORGANIZER NOTEBOOK FOR HOLDING INDEX CARDS

[75] Inventors: Elizabeth J. Ovitt, Fort Collins; Lana J. McCallum, Glen Haven, both of Colo.

[73] Assignee: CaseMinder, Inc., Fort Collins, Colo.

[21] Appl. No.: 09/159,263

[22] Filed: Sep. 23, 1998

[51] Int. Cl.[7] ..... B42F 7/00; B42F 17/00

[52] U.S. Cl. ..... 402/79; 281/31; 402/75

[58] Field of Search ..... 281/29, 31, 36, 281/37; 402/70, 75, 73

[56] References Cited

U.S. PATENT DOCUMENTS

| | | | |
|---|---|---|---|
| D. 247,042 | 1/1978 | Neilsen et al. | D19/76 |
| D. 248,962 | 8/1978 | Glaubinger et al. | D19/76 |
| D. 248,963 | 8/1978 | Macowski | D19/76 |
| D. 250,200 | 11/1978 | Glaubinger | D19/1 |
| D. 261,280 | 10/1981 | Goertz | D19/76 |
| D. 283,902 | 5/1986 | Goertz | D19/76 |
| D. 327,705 | 7/1992 | Aaldenberg et al. | D19/75 |
| D. 329,745 | 9/1992 | O'Brien | D3/56 |
| D. 330,115 | 10/1992 | O'Brien | D3/56 |
| D. 334,026 | 3/1993 | Polansky | D19/75 |
| D. 339,161 | 9/1993 | Evenson | D19/21 |
| D. 377,713 | 2/1997 | Chandler | D3/247 |
| D. 389,514 | 1/1998 | Bedol | D19/32 |
| 1,548,027 | 8/1925 | Dunbar . | |
| 2,020,214 | 5/1935 | Rendall | 154/43 |
| 2,079,817 | 5/1937 | Schade et al. | 129/1 |
| 2,495,687 | 1/1950 | Belmont . | |
| 2,523,724 | 9/1950 | Satz | 281/31 |
| 2,648,366 | 8/1953 | Higbee et al. | 150/34 |
| 2,716,985 | 9/1955 | Wolf . | |
| 3,046,932 | 7/1962 | Rodrigue | 116/335 |
| 3,970,397 | 7/1976 | Armstrong | 402/79 |
| 4,091,918 | 5/1978 | Soulakis et al. | 206/45.13 |
| 4,105,270 | 8/1978 | Bergkamp et al. | 312/330 R |
| 4,253,567 | 3/1981 | Goldammer | 206/387 |
| 4,255,872 | 3/1981 | William, Sr. | 206/232 |
| 4,306,737 | 12/1981 | Errichiello | 281/34 |
| 4,395,059 | 7/1983 | Russell | 282/29 B |
| 4,551,039 | 11/1985 | Basseches | 402/60 |
| 4,575,126 | 3/1986 | Grubbs | 402/29 |
| 4,594,016 | 6/1986 | Husbands | 402/21 |
| 4,614,450 | 9/1986 | Neiman | 40/124.2 |
| 4,699,538 | 10/1987 | Caine | 402/79 |
| 4,803,795 | 2/1989 | Questel et al. | 40/124.2 |
| 4,906,057 | 3/1990 | Davi et al. | 312/193 |
| 4,949,484 | 8/1990 | Finger | 40/124 |
| 5,033,899 | 7/1991 | Pitts et al. | 402/80 R |
| 5,213,433 | 5/1993 | An | 402/14 |
| 5,294,208 | 3/1994 | Tremmel, Jr. et al. | 402/70 |
| 5,333,908 | 8/1994 | Dorney et al. | 283/38 |
| 5,421,665 | 6/1995 | Strassberg | 402/79 |
| 5,494,366 | 2/1996 | Pell et al. | 402/73 |
| 5,590,911 | 1/1997 | Wilson | 283/36 |
| 5,732,977 | 3/1998 | Kohana | 281/45 |
| 5,911,441 | 6/1999 | Yamamoto | 281/15.1 |
| 5,924,227 | 7/1999 | Sommers | 40/360 |

*Primary Examiner*—Andrea L. Pitts
*Assistant Examiner*—Alisa L. Thurston
*Attorney, Agent, or Firm*—William E. Hein

[57] ABSTRACT

An organizer notebook for holding index cards provides complete visibility of work schedule and content at a glance, with portability, security, and the flexibility of retaining additional work materials. The orgainizer notebook includes a zippered case and a cardholder member retained within the zippered case. Conventional index cards are removably retained by the cardholder member.

4 Claims, 2 Drawing Sheets

ORGANIZER NOTEBOOK FOR HOLDING INDEX CARDS

BACKGROUND AND SUMMARY OF THE INVENTION

This invention relates generally to organizer notebooks and, more specifically, to an organizer notebook that is capable of retaining index cards.

Organizing one's workload by time in such a way that the complete work schedule and work activities are easily visible to the user is difficult in work situations that require moving from place to place. For example, homecare nurses are required to move from patient to patient and to perform various activities for each patient at different times. There is presently no satisfactory system available for assisting these nurses in tracking required activities over a period of time that can vary from a few days to a few months. Since homecare nurses spend the majority of their time away from the office, they require an organizer system that is portable and easy to use, that does not require extensive proficiency training, and that provides complete visibility of work activities to be performed during the upcoming week, as well as over a time period that may extend several weeks or months into the future.

A number of time organizer systems are presently commercially available. These systems include ringbinder systems that are both portable and secure. However, these prior art ringbinder systems are disadvantageous in that they do not readily and completely display future work activities, but instead require flipping through pages to view work to be performed on future dates. The user cannot look at time demands in organizer systems of this type and readily determine if the upcoming week's workload is reaching capacity. Since these prior art sytems employ back-to-back page printing, a second person covering a particular day's work must recopy or photocopy the associated pages. Removing and reinserting pages into a ringbinder is cumbersome. Snap mechanisms fail; rings become misaligned; and visibility is limited to one page at a time.

Some nurses use what are commonly referred to as travel charts. These charts contain copies of portions of a patient record. They are disadvantageous in that they duplicate information from a permanent patient chart that resides in the office. They therefore require photocopying time and put patient confidentiality at risk. Though information regarding upcoming events can be viewed, this system is not portable since it is the size of a file drawer and cannot be dropped without the risk of files flying everywhere.

Computerized calendars in the form of laptops, palmtops, and personal organizers are portable and do provide security for the information stored therein. However, they are typically expensive and do not provide easy and complete visibility of upcoming work activities.

A number of prior art references are directed to ringbinder time organizers. They do not provide at-a-glance views of upcoming work and simple, non-repetitive documentation. Representative of these references are U.S. Pat. Nos. 5,333,908, 5,033,899, 5,529,418, 5,590,911, 5,294,208, 5,494,366, 4,699,538, Des. 329,745, Des. 330,115, and Des. 389,514.

In addition, U.S. Pat. No. 4,551,039 is directed to an improved ringbinder in which paper can be removed and moved within the binder. However, this device is deficient in that it also fails to provide at-a-glance visibility of upcoming work activities.

U.S. Pat. Nos. Des. 380,235 and Des. 377,713 are directed to holders and cases for index cards and rotary file cards. However, these devices do not satisfactorily hold a multitude of cards.

U.S. Pat. Nos. Des. 339,161, Des. 334,026, Des. 247,042, and Des. 248,962 are directed to card holders. However, these devices are intended for stationary use as they have no covers, do not provide for security of information, and have no portability without risk of loss of the cards intended to be retained therein.

Exemplary of other types of card holders are those described in U.S. Pat. Nos. 5,732,977, 5,683,193, 5,421,665, 4,803,795, 4,105,270, 5,213,433, 4,949,484, 4,091,918, 4,906,057, Des. 261,280, and Des. 283,902. All of these devices are disadvantageous for use in homecare nursing applications, for example.

It would therefore be advantageous to provide an organizer notebook for holding index cards that provides complete workload visibilty at a glance, portability, security, and the flexibility of retaining additional work materials. Such an organizer notebook is provided, in accordance with the illustrated preferred embodiment of the present invention, to include a portable zippered case that prevents loss of the index cards retained therein in the event it is accidentally dropped. A cardholder member having a flat base is secured within the zippered case. Alternatively, the cardholder member may be removable from the zippered case. The cardholder member provides for flexibility of the content of the cards retained thereby, as well as the number of cards within a given section. Dated cards enable the user to quickly view upcoming work. Cards on which repetitive activity is documented may be easily moved within the cardholder member for association with a future date on which the activity is to be repeated. The zippered case also includes provision for holding pens, pencils, additional cards, and other papers, as desired.

DESCRIPTION OF THE PREFERRED EMBODIMENT

Figure 1:
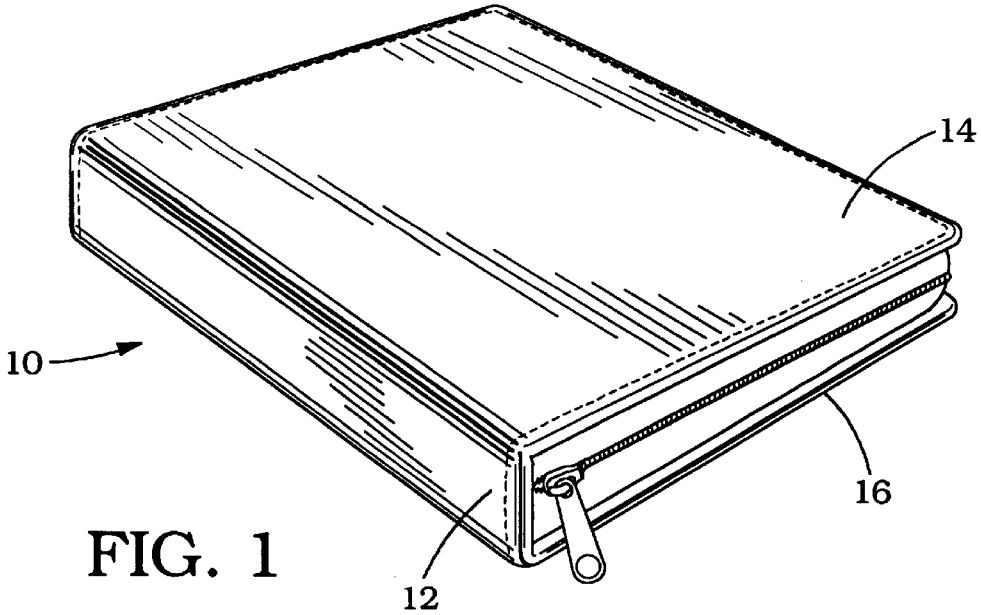
FIG. 1 is a pictorial diagram of the organizer notebook of the present invention illustrated in the closed position.
Figure 2:
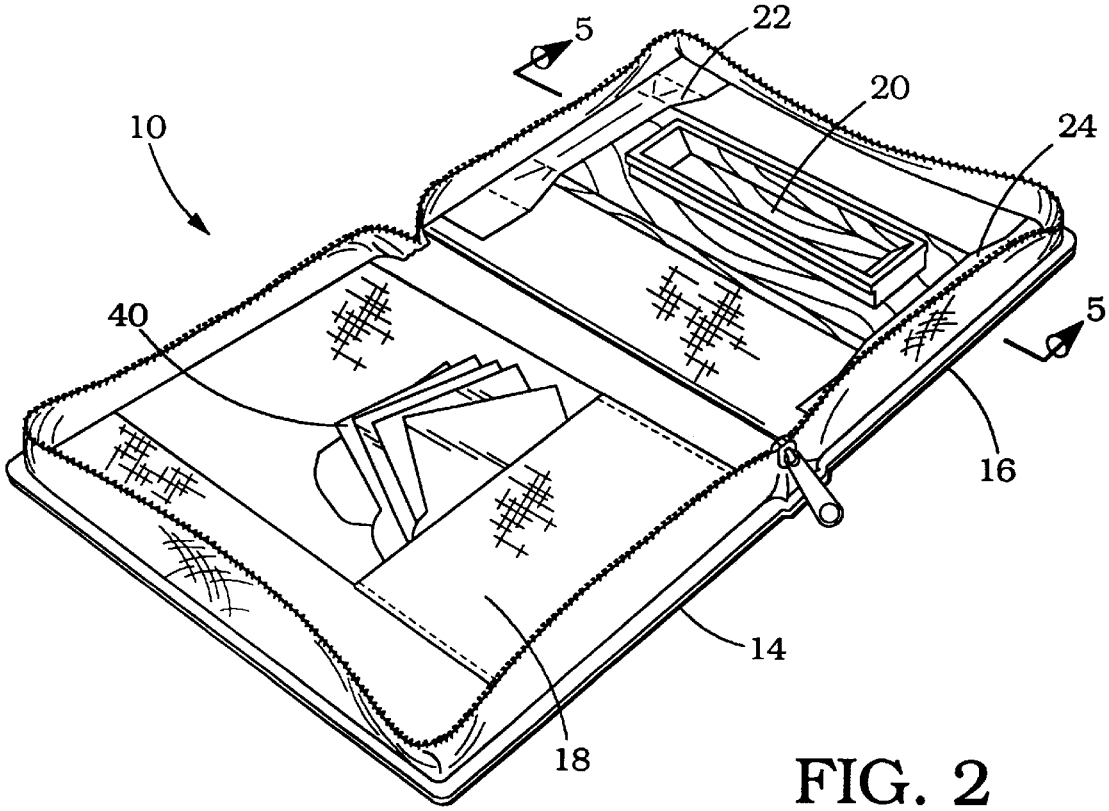
FIG. 2 is a pictorial diagram of the organizer notebook of FIG. 1 illustrated in the open position.
Figure 3:
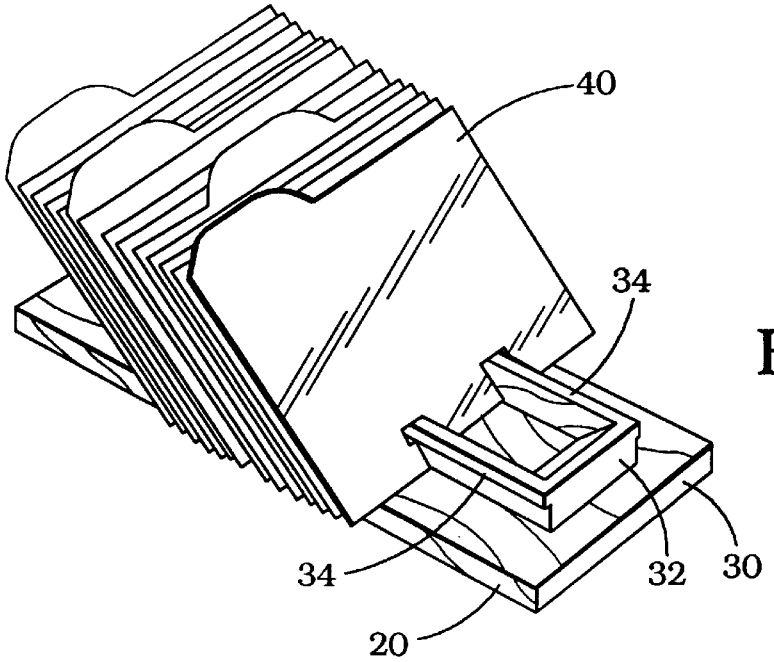
FIG. 3 is a pictorial diagram of the cardholder member of the organizer notebook of FIG. 2 illustrating the way in which typical index cards are retained thereby.
Figure 4:
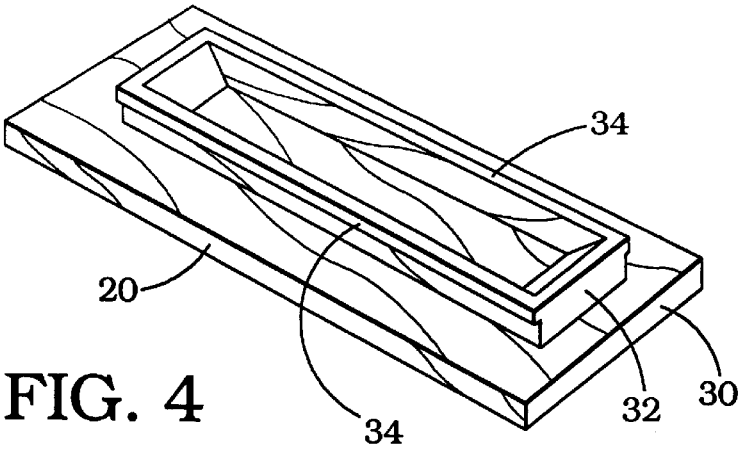
FIG. 4 is a pictorial diagram of the removable cardholder member of FIG. 3 with the index cards of FIG. 3 removed therefrom.
Figure 5:
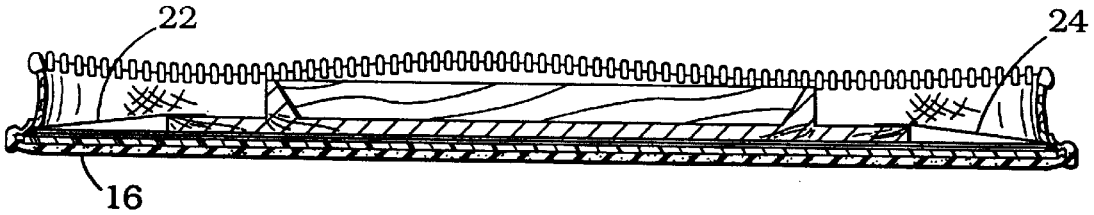
FIG. 5 is a cross sectional diagram of the organizer notebook of FIGS. 1 and 2, taken along the line 5—5 of FIG. 2.

Referring now to FIGS. 1 and 2, there is shown an organizer notebook 10 that is adapted to be zippered into the closed position illustrated in FIG. 1 and to be unzippered into the open position illustrated in FIG. 2. Organizer notebook 10 includes a spine portion 12, a left panel 14, and a right panel 16. One or more pockets 18 are sewn or otherwise formed on the inside surface of the left panel 14 of organizer notebook 10 for the purpose of storing additional index cards, pens, etc. An elongated cardholder member 20 is adapted to be inserted, at the ends thereof, beneath a pair of pockets 22, 24 formed on the inside surface of the right panel 16 of organizer notebook 10. Cardholder member 20 may be permanently attached, by conventional means such as riveting, to the inside surface of the right panel 16 or the left panel 18 of organizer notebook 10. Alternatively, cardholder member 20 may be removably attached to the inside surface of the right panel 16 or left panel 18 by conventional attachment means such as velcro fasteners, elastic straps, etc. Cardholder member 20 includes an elongated flat base plate 30 and a correspondingly elongated card retainer 32 having a pair of flanged side rails 34 over which a plurality of index cards 40 may be removably positioned, as illustrated in FIG. 3. Index cards 40 may be of the conventional type described in U.S. Pat. No. Des. 250,200, having a pair of retention perforations formed along the bottom edge thereof. Side rails 34 of cardholder member 20 are correspondingly formed to mate with the retention perforations in index cards 40.

We claim:

1. An organizer notebook for retaining a multiplicity of index cards of the type having a pair of retention perforations formed along a bottom edge thereof, the organizer notebook comprising:

left and right panel members, each of said left and right panel members being generally flat and being equal in width and height;

a spine member having a height equal to the height of each of said left and right panel members and having a width substantially less than the width of each of said left and right panel members, said spine member being positioned between said left and right panel members so as to hingedly connect said left and right panel members;

zipper means coupled to said left and right panel members along a peripheral edge thereof away from said spine member to thereby enable a user to zip said organizer notebook into a folded closed position and to unzip said organizer notebook into a flat open position; and a cardholder member attached to an inside surface of a selected one of said left and right panel members, said cardholder member comprising an elongated flat base plate and a correspondingly elongated card retainer having an area less than an area of said base plate, said card retainer being formed on a top surface of said base plate, said card retainer including a pair of parallel flanged side rails over which a multiplicity of said index cards may be removably positioned, said flanged side rails being formed to mate with said retention perforations in said index cards.

2. An organizer notebook as in claim 1, wherein an opposite one of said left and right panel members to said selected one of said left and right panel members includes one or more pockets for storing selected articles.

3. An organizer notebook as in claim 1, wherein said cardholder is permanently attached to said inside surface of said selected one of said left and right panel members.

4. An organizer notebook as in claim 1, wherein said cardholder is removably attached to said inside surface of said selected one of said left and right panel members.

* * * * *